US011396739B2

(12) United States Patent
Popp et al.

(10) Patent No.: US 11,396,739 B2
(45) Date of Patent: Jul. 26, 2022

(54) MODULAR GROUND ENGAGEMENT TOOLING SYSTEM

(71) Applicant: JOY GLOBAL SURFACE MINING INC, Milwaukee, WI (US)

(72) Inventors: James R. Popp, Oak Creek, WI (US); Richard Nicoson, Hartford, WI (US)

(73) Assignee: JOY GLOBAL SURFACE MINING INC, Milwaukee, WI (US)

( * ) Notice: Subject to any disclaimer, the term of this patent is extended or adjusted under 35 U.S.C. 154(b) by 320 days.

(21) Appl. No.: 15/816,616

(22) Filed: Nov. 17, 2017

(65) Prior Publication Data

US 2018/0142447 A1 May 24, 2018

Related U.S. Application Data

(60) Provisional application No. 62/424,161, filed on Nov. 18, 2016.

(51) Int. Cl.

| | |
|---|---|
| ***E02F 9/28*** | (2006.01) |
| ***E02F 3/60*** | (2006.01) |
| *E02F 3/30* | (2006.01) |
| *E02F 3/46* | (2006.01) |

(52) U.S. Cl.

CPC ..... *E02F 9/2833* (2013.01); *E02F 3/60* (2013.01); *E02F 3/304* (2013.01); *E02F 3/46* (2013.01)

(58) Field of Classification Search

None

See application file for complete search history.

(56) References Cited

U.S. PATENT DOCUMENTS

| | | | | |
|---|---|---|---|---|
| 2,113,420 A * | 4/1938 | Younie | ..... | E02F 9/2825 37/456 |
| 2,145,663 A * | 1/1939 | Reynolds | ..... | E02F 9/2833 37/454 |
| 2,353,685 A * | 7/1944 | Askue | ..... | E02F 9/2866 37/450 |

(Continued)

FOREIGN PATENT DOCUMENTS

| | | |
|---|---|---|
| CN | 1201500 A | 12/1998 |
| CN | 201165631 Y | 12/2008 |

(Continued)

OTHER PUBLICATIONS

Chilean Patent Office Action for Application No. 2017-02923 dated Mar. 12, 2019 (10 pages, statement of relevance included).

(Continued)

*Primary Examiner* — Jessica H Lutz

(74) *Attorney, Agent, or Firm* — Michael Best & Friedrich LLP

(57) ABSTRACT

A tooling system includes a dipper having a lip with a plurality of apertures, the apertures extending at least partially through the lip. The tooling system also includes a modular adapter configured to be inserted partially into one of the apertures along an axis of insertion. The adapter is configured to be releasably coupled to the lip. The adapter includes a first portion configured to extend into the aperture, and a second portion configured to extend out of the aperture. The tooling system also includes a locking system including a fastener configured to extend at least partially into the aperture and couple to the adapter to the lip.

20 Claims, 12 Drawing Sheets

(56) References Cited

U.S. PATENT DOCUMENTS

| | | | | | |
|---|---|---|---|---|---|
| 2,702,490 | A * | 2/1955 | Launder | E02F 9/2841 | 411/512 |
| 2,772,492 | A * | 12/1956 | Murtaugh | E02F 9/2841 | 37/457 |
| 2,925,673 | A * | 2/1960 | Sennholtz | E02F 9/2833 | 37/455 |
| 2,984,028 | A * | 5/1961 | Renner | E02F 9/2841 | 37/458 |
| 3,203,488 | A * | 8/1965 | Eastwood, III | E02F 5/32 | 172/713 |
| 3,277,592 | A * | 10/1966 | Launder | E02F 9/2875 | 37/457 |
| 3,334,431 | A * | 8/1967 | Phillips | E02F 9/2841 | 37/457 |
| 3,440,745 | A * | 4/1969 | Palm | E02F 9/2841 | 37/455 |
| 3,466,772 | A * | 9/1969 | Phillips | E02F 9/2841 | 37/457 |
| 3,520,076 | A * | 7/1970 | Nichols | E02F 9/2841 | 37/446 |
| 3,585,741 | A * | 6/1971 | Heusler | E02F 9/2833 | 37/455 |
| T911,018 | I4 * | 6/1973 | Radigan | E02F 9/2816 | 37/454 |
| 3,774,324 | A * | 11/1973 | Lafond | E02F 9/2841 | 37/457 |
| 3,864,853 | A * | 2/1975 | Klett | E02F 9/2841 | 37/446 |
| 3,894,349 | A * | 7/1975 | Moreau | E02F 9/2841 | 37/457 |
| 3,919,792 | A * | 11/1975 | Hahn | E02F 9/2825 | 37/455 |
| 4,205,469 | A | 6/1980 | Johansson et al. | | |
| 4,321,762 | A * | 3/1982 | Hemphill | E02F 9/2816 | 37/444 |
| 4,360,981 | A * | 11/1982 | Bierwith | E02F 3/241 | 37/450 |
| 4,516,339 | A * | 5/1985 | Hemphill | E02F 9/2808 | 37/454 |
| 4,625,439 | A * | 12/1986 | Johansson | E02F 9/2833 | 37/456 |
| 5,230,548 | A * | 7/1993 | Southern | E21C 35/19 | 299/104 |
| 5,410,826 | A | 5/1995 | Immel et al. | | |
| 5,680,717 | A * | 10/1997 | Bierwith | E02F 9/2841 | 37/341 |
| 6,834,449 | B2 * | 12/2004 | Leslie | E02F 3/60 | 37/398 |
| 6,986,216 | B2 | 1/2006 | Emrich et al. | | |
| 7,640,684 | B2 * | 1/2010 | Adamic | E02F 9/2825 | 37/456 |
| 7,788,830 | B2 | 9/2010 | Woerman et al. | | |
| 8,434,248 | B2 * | 5/2013 | Woerman | E02F 9/2825 | 37/456 |
| 8,540,033 | B2 * | 9/2013 | Stanley | A01B 33/142 | 172/548 |
| 9,951,500 | B2 * | 4/2018 | Kunz | E02F 9/2833 | |
| 9,957,696 | B2 * | 5/2018 | Kunz | E02F 9/2833 | |
| 9,963,857 | B2 * | 5/2018 | Ruvang | E02F 9/2825 | |
| 10,036,412 | B2 * | 7/2018 | Bjerke | E02F 9/2833 | |
| 10,107,098 | B2 * | 10/2018 | Sollami | B28D 1/188 | |
| 10,407,880 | B2 * | 9/2019 | Campomanes | E02F 9/2833 | |
| 10,513,837 | B2 * | 12/2019 | Campomanes | E02F 9/2883 | |
| 2008/0276500 | A1 * | 11/2008 | Ruvang | E02F 9/2833 | 37/452 |
| 2011/0099862 | A1 | 5/2011 | Snyder | | |
| 2012/0246982 | A1 | 10/2012 | Bentley | | |
| 2013/0145659 | A1 | 6/2013 | LaHood et al. | | |
| 2015/0211214 | A1 | 7/2015 | Dallard et al. | | |
| 2016/0237658 | A1 | 8/2016 | Ruvang | | |

FOREIGN PATENT DOCUMENTS

| | | | |
|---|---|---|---|
| CN | 101337345 | A | 1/2009 |
| CN | 102027171 | A | 4/2011 |
| CN | 102812206 | A | 12/2012 |
| CN | 102828750 | A | 12/2012 |
| CN | 102900012 | A | 1/2013 |
| CN | 105408555 | A | 3/2016 |
| RU | 2052031 | C1 | 1/1996 |
| WO | 2012162424 | A1 | 11/2012 |

OTHER PUBLICATIONS

Chinese Patent Office Action and Search Report for Application No. 201711143877 6 dated Feb. 9, 2021 (10 pages including English summary).

Russian Patent Office Action and Search Report for Application No. 2017140020 dated Mar. 16, 2021 (12 pages including English translation).

Chinese Patent Office Action for Application No. 201711143877.6 dated Oct. 8, 2021 (17 pages, translation included).

Peruvian Patent Office Action for Application No. 2439-2017 dated Aug. 16, 2021 (9 pages, translation included).

Chinese Patent Office Action for Application No. 201711143877.6 dated Mar. 18, 2022 (12 pages, including English translation).

Mexican Patent Office Action for Application No. MX/a/2017/014900 dated Mar. 18, 2022 (8 pages, including English translation).

* cited by examiner

MODULAR GROUND ENGAGEMENT TOOLING SYSTEM

CROSS-REFERENCE TO RELATED APPLICATIONS

This application claims priority to U.S. Provisional Application Ser. No. 62/424,161, filed Nov. 18, 2016, the disclosure of which is incorporated herein by reference in its entirety and to which priority is claimed.

BACKGROUND

The present invention relates to a mining shovel, and more specifically to a ground engagement tooling system for the dipper of a mining shovel.

Industrial mining machines, such as electric rope or power shovels, draglines, etc., are used to execute digging operations to remove material from a bank of a mine. On a conventional rope shovel, a dipper is attached to a handle, and the dipper is supported by a cable, or rope, that passes over a boom sheave. The rope is secured to a bail that is pivotably coupled to the dipper. The handle is moved along a saddle block to maneuver a position of the dipper. During a hoist phase, the rope is reeled in by a winch in a base of the machine, lifting the dipper upward through the bank and liberating the material to be dug. To release the material disposed within the dipper, a dipper door is pivotally coupled to the dipper. When not latched to the dipper, the dipper door pivots away from a bottom of the dipper, thereby freeing the material out through a bottom of the dipper.

The dipper often includes ground engagement tooling, including adapters, tooth points, and/or shrouds that are coupled to a lip of the dipper. The ground engagement tooling is used to dig through the bank of material, and to absorb a significant amount of the overall wear experienced by the dipper. Current adapters and shrouds are coupled directly to the lip with legs that straddle over both a top and bottom of the lip. The legs provide the dual purpose of both structurally supporting the adapter or shroud to the lip and also providing added material wear protection along the top and bottom of the lip, in addition to the wear protection already afforded by a portion of the adapter or shroud that extends forward from the lip.

SUMMARY

In accordance with one construction, a tooling system includes a dipper having a lip with a plurality of apertures, the apertures extending at least partially through the lip. The tooling system also includes a modular adapter configured to be inserted partially into one of the apertures along an axis of insertion. The adapter is configured to be releasably coupled to the lip. The adapter includes a first portion configured to extend into the aperture, and a second portion configured to extend out of the aperture. The tooling system also includes a locking system including a fastener configured to extend at least partially into the aperture and couple to the adapter to the lip.

In accordance with another construction, an adapter configured to be releasably coupled to a lip of a dipper includes a first portion and a second portion extending from the first portion. The first portion is configured to be inserted along an axis into a first aperture in the lip. A second aperture extends through the first portion. The second aperture is configured to receive a fastener.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited.

Figure 1:
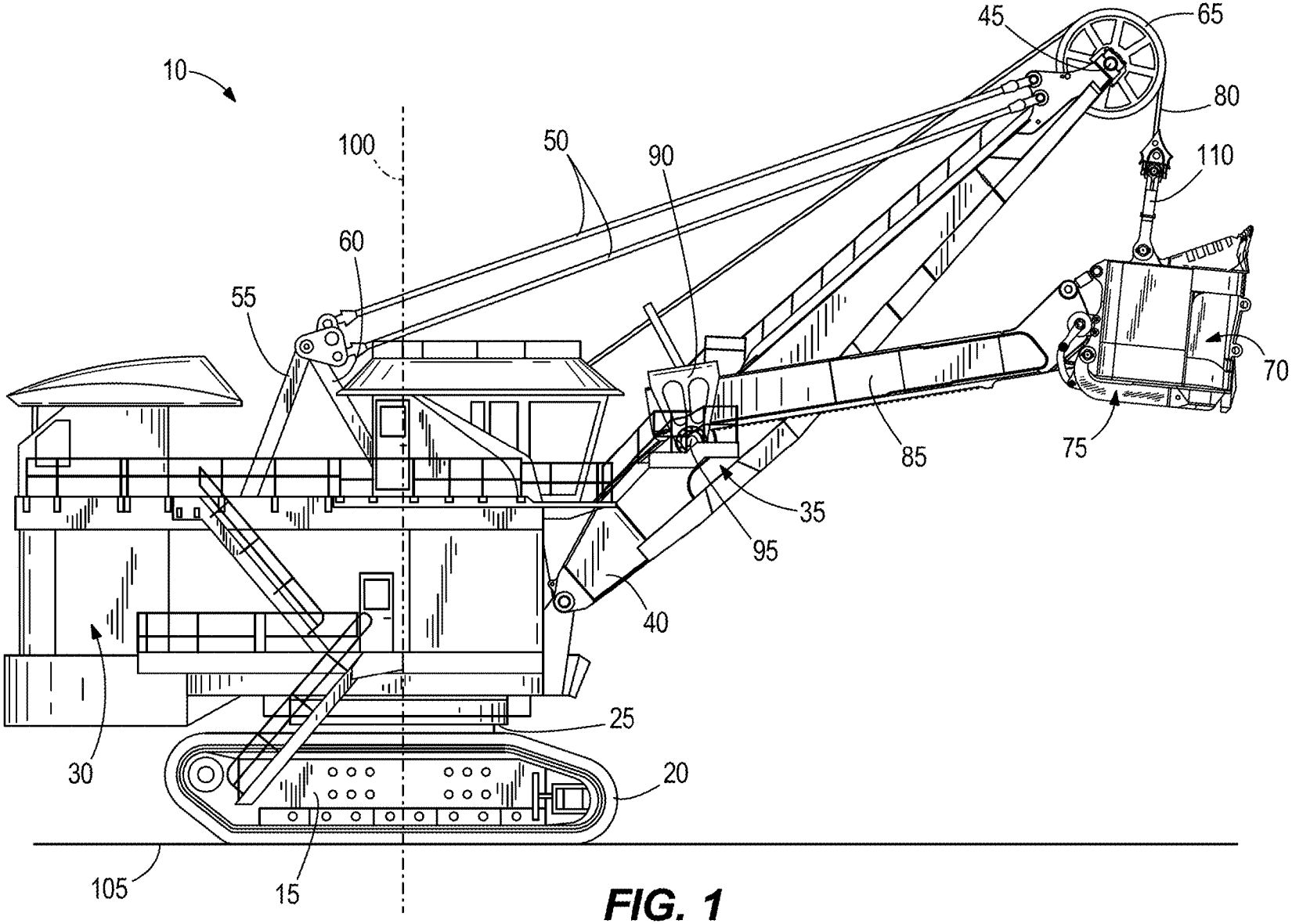
FIG. 1 is a perspective view of a mining shovel.
Figure 2:
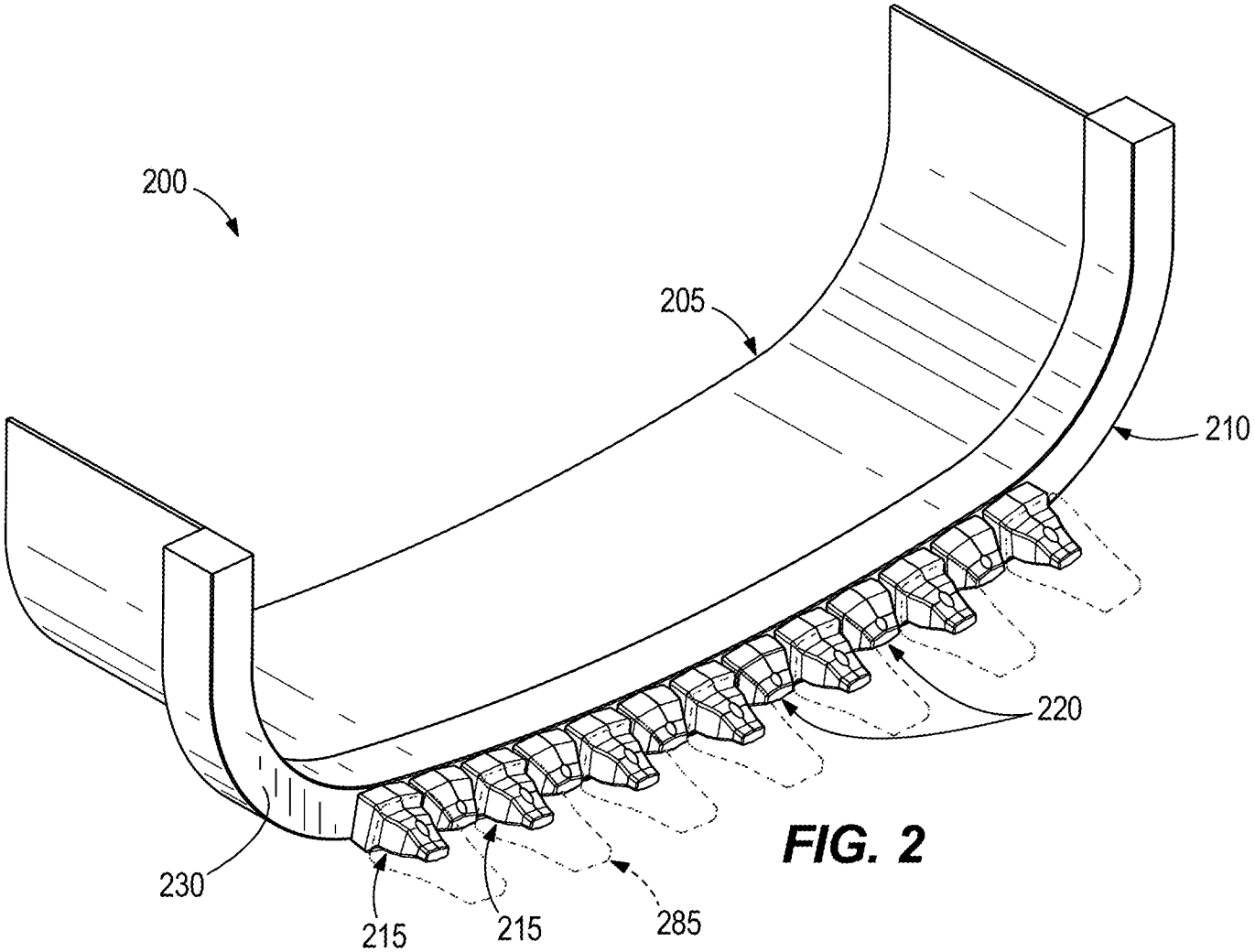
FIGS. 2 and 3 are perspective views of a modular ground engagement tooling system according to one construction, for use with the mining shovel.

FIG. 1 illustrates a power shovel 10. The shovel 10 includes a mobile base 15, drive tracks 20, a turntable 25, a revolving frame 30, a boom 35, a lower end 40 of the boom 35 (also called a boom foot), an upper end 45 of the boom 35 (also called a boom point), tension cables 50, a gantry tension member 55, a gantry compression member 60, a sheave 65 rotatably mounted on the upper end 45 of the boom 35, a dipper 70, a dipper door 75 pivotally coupled to the dipper 70, a hoist rope 80, a winch drum (not shown), a dipper handle 85, a saddle block 90, a shipper shaft 95, and a transmission unit (also called a crowd drive, not shown). The rotational structure 25 allows rotation of the upper frame 30 relative to the lower base 15. The turntable 25 defines a rotational axis 100 of the shovel 10. The rotational axis 100 is perpendicular to a plane 105 defined by the base 15 and generally corresponds to a grade of the ground or support surface.

The mobile base 15 is supported by the drive tracks 20. The mobile base 15 supports the turntable 25 and the revolving frame 30. The turntable 25 is capable of 360-degrees of rotation relative to the mobile base 15. The boom 35 is pivotally connected at the lower end 40 to the revolving frame 30. The boom 35 is held in an upwardly and outwardly extending relation to the revolving frame 30 by the tension cables 50, which are anchored to the gantry tension member 55 and the gantry compression member 60. The gantry compression member 60 is mounted on the revolving frame 30.

The dipper 70 is suspended from the boom 35 by the hoist rope 80. The hoist rope 80 is wrapped over the sheave 65 and attached to the dipper 70 at a bail 110. The hoist rope 80 is anchored to the winch drum (not shown) of the revolving frame 30. The winch drum is driven by at least one electric motor (not shown) that incorporates a transmission unit (not shown). As the winch drum rotates, the hoist rope 80 is paid out to lower the dipper 70 or pulled in to raise the dipper 70. The dipper handle 85 is also coupled to the dipper 70. The dipper handle 85 is slidably supported in the saddle block 90, and the saddle block 90 is pivotally mounted to the boom 35 at the shipper shaft 95. The dipper handle 85 includes a rack and tooth formation thereon that engages a drive pinion (not shown) mounted in the saddle block 90. The drive pinion is driven by an electric motor and transmission unit (not shown) to extend or retract the dipper handle 85 relative to the saddle block 90.

An electrical power source (not shown) is mounted to the revolving frame 30 to provide power to a hoist electric motor (not shown) for driving the hoist drum, one or more crowd electric motors (not shown) for driving the crowd transmission unit, and one or more swing electric motors (not shown) for turning the turntable 25. Each of the crowd, hoist, and swing motors is driven by its own motor controller, or is alternatively driven in response to control signals from a controller (not shown).

FIGS. 2-10 illustrate a modular ground engagement tooling system 200 for use with the shovel machine 10 or with other mining machines. The modular ground engagement tooling system 200 includes a dipper 205 having a lip 210, and a plurality of modular adapters 215 and modular shrouds 220 that are releasably coupled to the lip 210 through apertures 225 in the lip 210.

In some constructions, the dipper 70 of the shovel 10 may be replaced with the dipper 205. In other constructions, the dipper 70 is retrofitted to include the apertures 225 to receive the various modular adapters 215 and modular shrouds 220. In yet other constructions, a mining machine is initially constructed to include the dipper 205.

Figure 4:
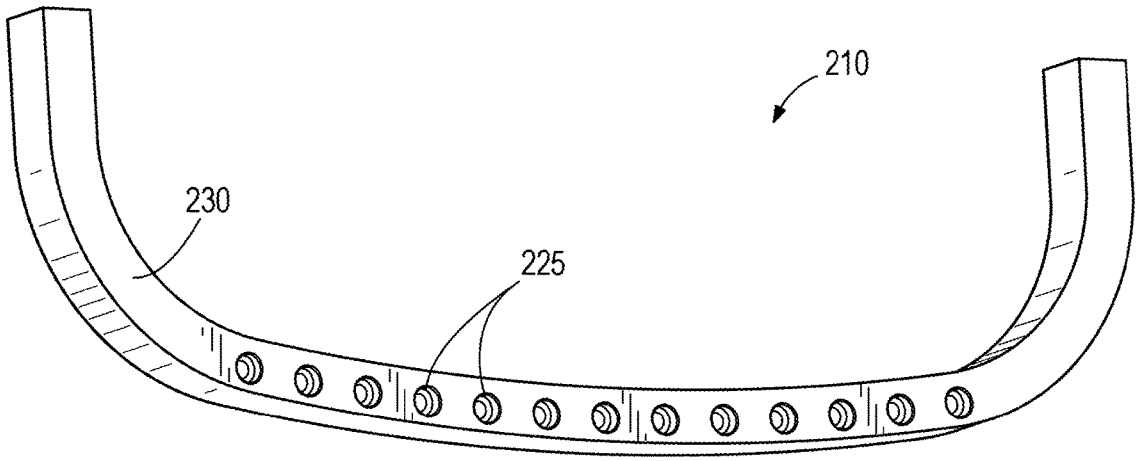
FIG. 4 is a perspective view of the modular ground engagement tooling system, illustrating a lip of a dipper, and a plurality of apertures in the lip.

With reference to FIG. 4, in the illustrated construction the lip 210 includes thirteen apertures 225 spaced evenly apart from one another. Other constructions include different numbers and arrangements of apertures 225 than that illustrated. For example, in some constructions, fewer than thirteen apertures 225 are provided. In some constructions, more than thirteen apertures 225 are provided. In some constructions, the apertures 225 are spaced differently than that illustrated. In some constructions, at least one of the apertures 225 is of a different size and/or shape than that illustrated. In some constructions, all of the apertures 225 are of identical size and shape, whereas in other constructions, at least one of the apertures 225 is of a different size and/or shape than another of the apertures 225.

Figure 8:
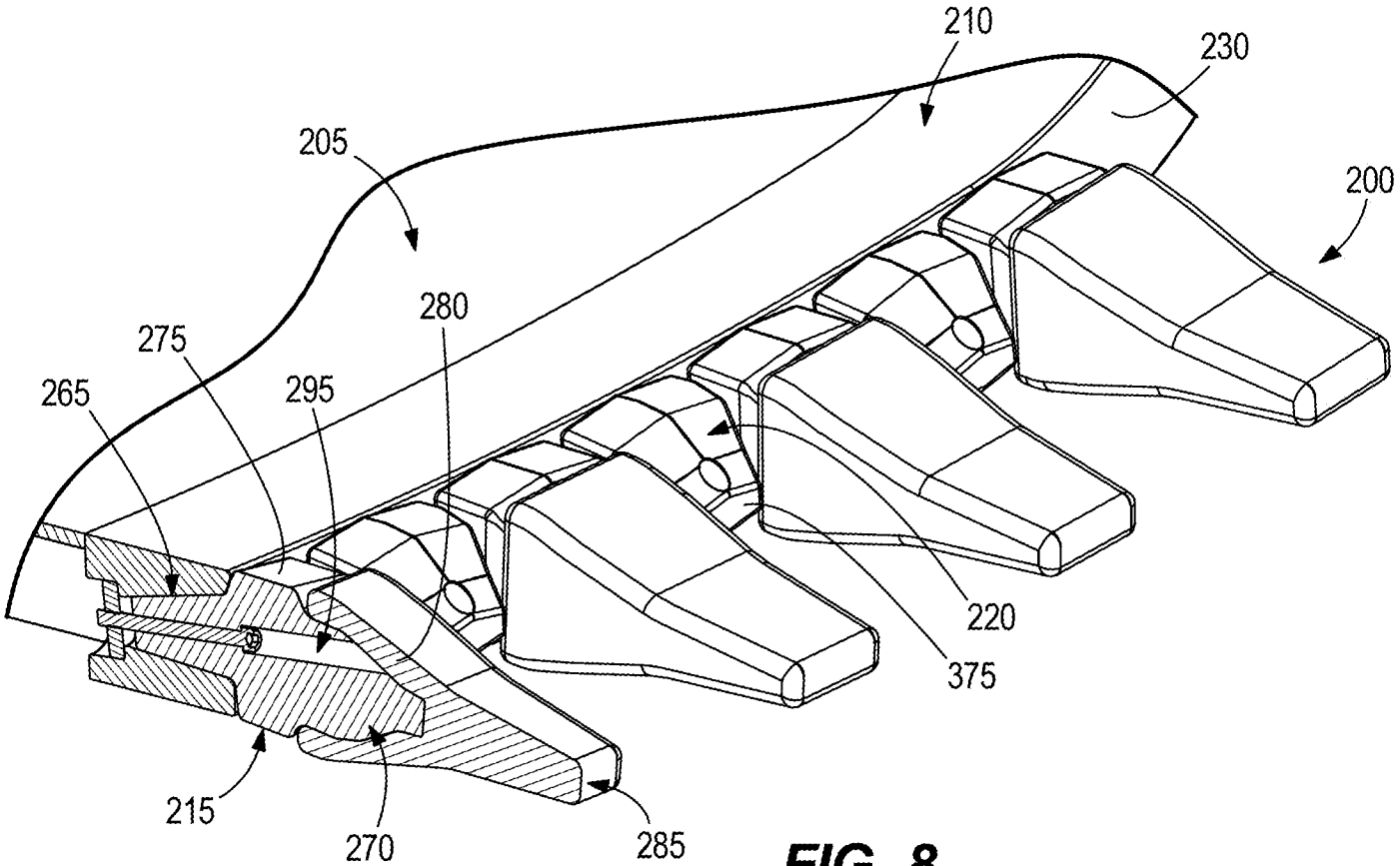
Figure 9:
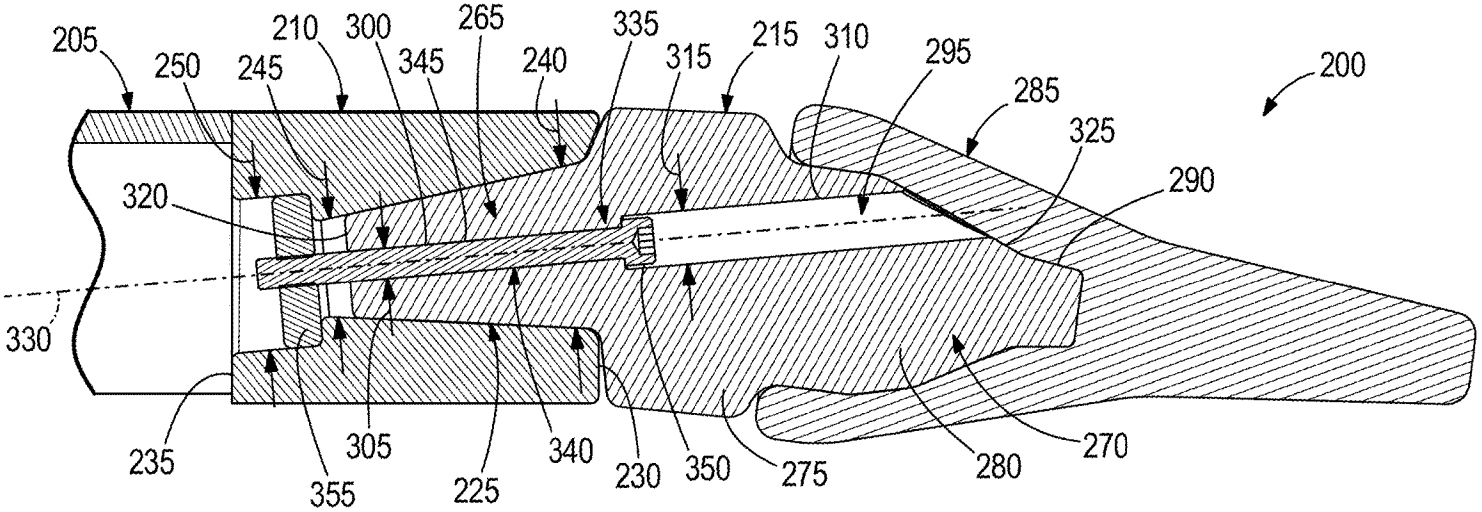

With reference to FIGS. 2-4, and 8-10, each of the apertures 225 extends entirely through the lip 210 from a first, outer side 230 of the lip 210 to a second, opposite inner side 235 of the lip 210. As illustrated in FIG. 9, the apertures 225 vary in diameter moving from the first side 230 of the lip 210 to the second side 235 of the lip 210. In the illustrated construction, the apertures 225 each have a first diameter 240 adjacent the first side 230, a second diameter 245 between the first and second sides 230, 235, and a third diameter 250 adjacent the second side 235. In the illustrated construction, the first diameter 240 is larger than both the second diameter 245 and the third diameter 250, and the second diameter 245 is smaller than both the first diameter 240 and the third diameter 250.

Figure 3:
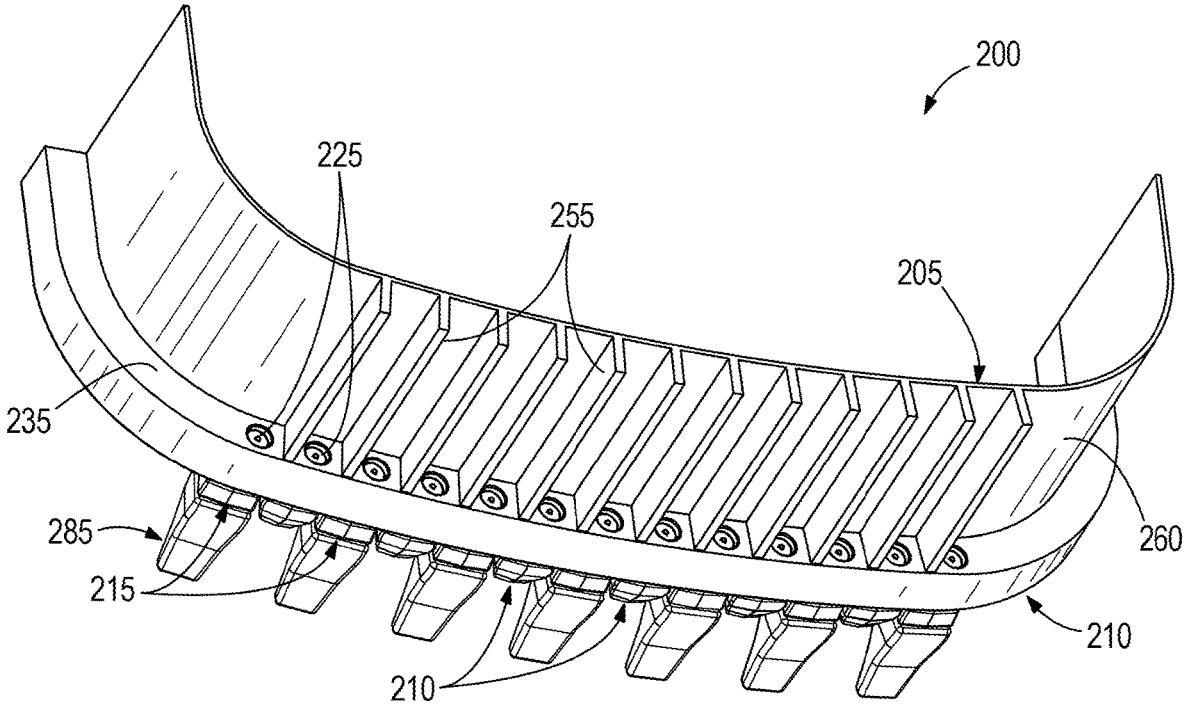

With reference to FIG. 3, in the illustrated construction the dipper 205 includes reinforcing elements 255 positioned along a bottom 260 of the dipper 205. The reinforcing elements 255 are elongate ribs that are spaced evenly apart from one another and extend parallel to one another along the dipper 205. The reinforcing elements 255 extend along the bottom 260 of the dipper 205 to the inner side 235 of the lip 210. The reinforcing elements 255 alternate with the apertures 225, such that a single reinforcing element 255 is positioned between any two of the apertures 225 when viewed along a direction that is perpendicular to the inner side 235 of the lip 210. Other constructions include different sizes, shapes, and arrangements of reinforcing elements 255 than that illustrated. In some constructions, the dipper 205 does not include reinforcing elements 255.

Figure 5:
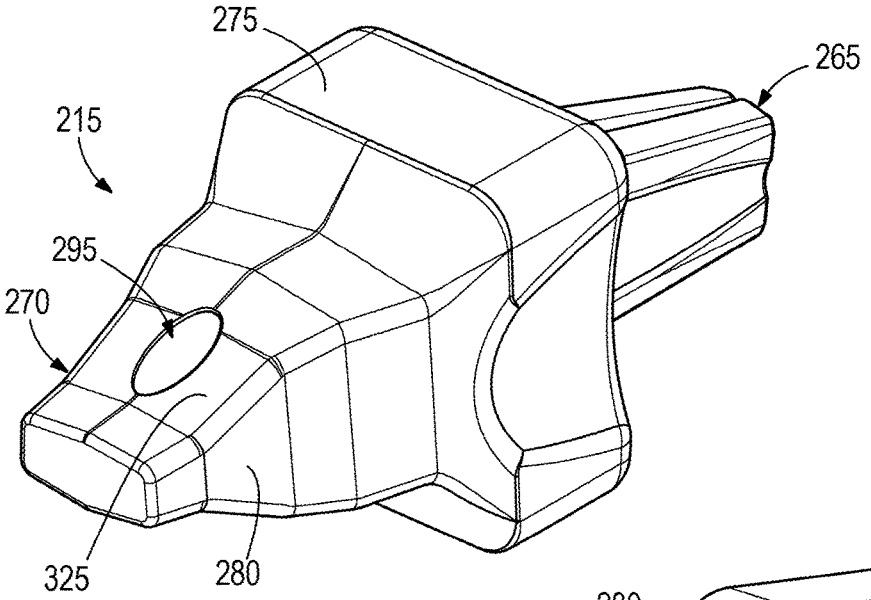
FIGS. 5-9 are perspective and cross-sectional views of modular adapters of the modular ground engagement tooling system.
Figure 6:
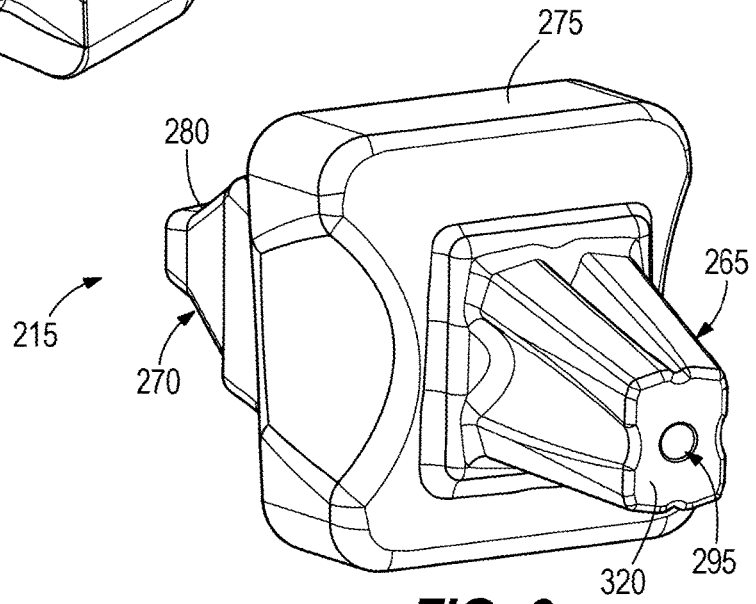
Figure 7:
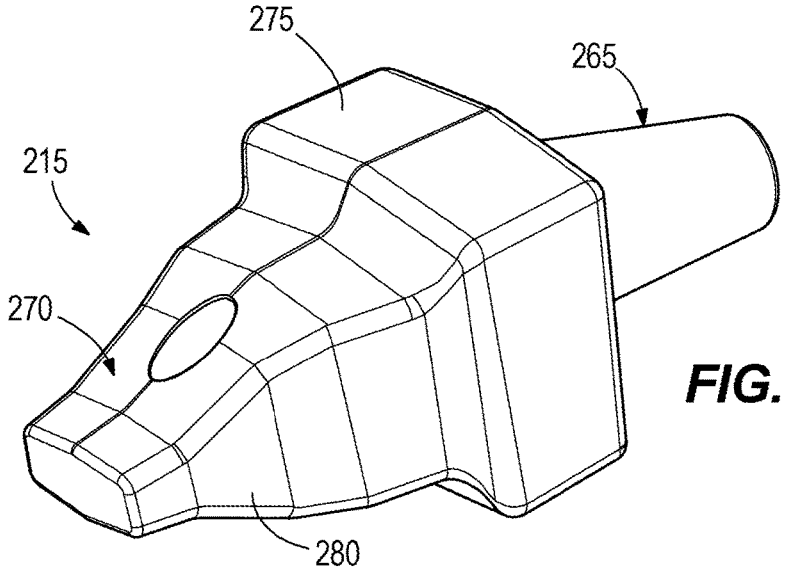

With reference to FIGS. 5-9, each of the modular adapters 215 includes a first portion 265 sized and shaped to fit into any one of the apertures 225, and a second portion 270 extending from the first portion 265 that is sized and shaped to extend out of the aperture 225. In the illustrated construction, the first portion 265 is an elongate stem sized and shaped to slide into one of the apertures 225, and to provide structural support and stability for the modular adapter 215 on the dipper 205 (e.g., as opposed to using legs straddling opposite sides of a lip of a dipper as found in current adapters). The first portion 265 tapers in cross-sectional area, such that the first portion 265 has a larger cross-sectional area closer to the second portion 270 than away from the second portion 270. In the illustrated construction, the first portion 265 has an overall size and shape that is approximately equal to a size and shape of at least one of the apertures 225, such that the first portion 265 generally maintains a frictional fit inside of the aperture 225 once inserted into the aperture 225. As illustrated in FIGS. 5 and 6, in some constructions the first portion 265 has a generally clover-shaped cross-section. However, other constructions include various other shapes and sizes than that illustrated. For example, as illustrated in FIG. 7 in some constructions the modular adapter 215 has a first portion 265 with a circular cross-sectional shape.

With continued reference to FIGS. 5-9, the second portion 270 includes a central body 275 and a mating projection 280 that extends from the central body 275 and is sized and shaped to couple to a tooth point 285. The first portion 265 of the modular adapter 215 extends from the central body 275. The central body 275 has a larger cross-sectional area than both the first portion 265 and the aperture 225, such that when the modular adapter 215 is coupled to the lip 210, the central body 275 abuts against the first outer side 230 of the lip 210 (FIGS. 8 and 9). The mating projection 280 has a smaller cross-sectional area than the central body 275, and generally tapers in cross-sectional area moving away from the central body 275. As illustrated in FIG. 9, the mating projection 280 is sized and shaped to fit into a correspondingly-shaped female recess 290 of the tooth point 285. The tooth point 285 absorbs wear from material dug up by the shovel 10, and is held onto the mating projection 280 and the modular adapter 215 via any of a number of different mechanisms or techniques. For example, in some constructions, the tooth point 285 is held onto the mating projection 280 purely via a frictional fit. In other constructions, a pin or other structure (e.g., a commercially available structure or system) is used to hold the tooth point 285 onto the modular adapter 215. In some constructions the tooth point 285 is a commercially available tooth point.

With continued reference to FIGS. 5-9, the modular adapter 215 includes an adapter aperture 295 that extends from the first portion 265 of the modular adapter 215 to the second portion 270 of the modular adapter 215. As illustrated in FIG. 9, the adapter aperture 295 is a through-aperture having a first region 300 with a first diameter 305 and a second region 310 with a second diameter 315. In some constructions, the first region 300 is threaded. The second diameter 315 is larger than the first diameter 305. The adapter aperture 295 extends from an end surface 320 of the first portion 265 to an inclined surface 325 of the mating projection 280, along an axis 330 (FIG. 9). As illustrated in FIG. 9, the axis 330 is identical to an axis of insertion of the first portion 265 into the aperture 225 of the lip 210.

With continued reference to FIG. 9, the modular ground engagement tooling system 200 includes a locking system 335 that releasably locks the modular adapter 215 to the lip 210. In the illustrated construction, the locking system 335 includes a fastener 340 (e.g., threaded bolt) that is shaped and sized to extend into the adapter aperture 295 of the modular adapter 215. The fastener 340 includes a first portion 345 having a diameter equal to or less than the first diameter 305 of the adapter aperture 295, and a second portion 350 (e.g., a head) having a diameter greater than the first diameter 305 and equal to or less than the second diameter 315 of the adapter aperture 295. The fastener 340 may be inserted through the adapter aperture 295 at the inclined surface 325 until the second portion 350 reaches a transition between the first region 300 and the second region 310 of the adapter aperture 295, where the second portion 350 is then prevented from further translation along the axis 330. In some constructions, the second portion 350 is a head that receives a tool to push, thread, or otherwise move the fastener 340 through the adapter aperture 295.

With continued reference to FIG. 9, the locking system 335 also includes a nut 355 (e.g., threaded) that receives the fastener 340. As illustrated in FIG. 8, the nut 355 has a diameter that is greater than the second diameter 245 of the aperture 225 of the lip 210. By rotating the fastener 340 through the nut 355, and/or rotating the nut 355 over the fastener 340, the fastener 340 and the nut 355 are tightened relative to one another, and the modular adapter 215 is pulled tightly against the first, outer side 230 of the lip 210.

Figure 10:
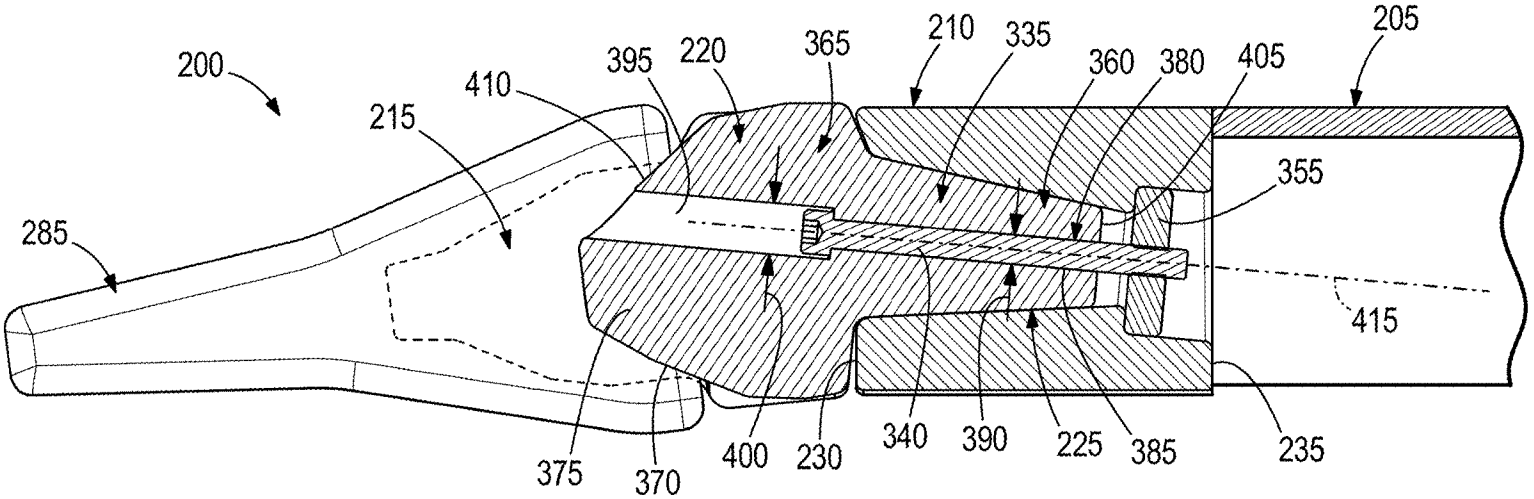
FIG. 10 is a cross-sectional view of a modular shroud of the modular ground engagement tooling system.

With reference to FIG. 10, each of the modular shrouds 220 includes a first portion 360 sized and shaped to fit into any one of the apertures 225, and a second portion 365 extending from the first portion 360 that is sized and shaped to extend out of the aperture 225. In the illustrated construction, the first portion 360 is an elongate stem sized and shaped to slide into one of the apertures 225. The first portion 360 tapers in cross-sectional area, such that the first portion 360 has a larger cross-sectional area closer to the second portion 365 than away from the second portion 365. In the illustrated construction, the first portion 360 has an overall size and shape that is approximately equal to a size and shape of at least one of the apertures 225, such that the first portion 360 generally maintains a frictional fit inside of the aperture 225.

With continued reference to FIG. 10, the second portion 365 includes a central body 370 and a wear projection 375 that extends from the central body 370. The first portion 360 of the modular shroud 220 extends from the central body 370. As illustrated in FIG. 10, the central body 370 has a larger cross-sectional area than both the first portion 360 and the aperture 225 in the lip 210, such that when the modular shroud 220 is coupled to the lip 210, the central body 370 abuts against the first outer side 230 of the lip 210. The wear projection 375 has a smaller cross-sectional area than the central body 370, and generally tapers in cross-sectional area moving away from the central body 370. As illustrated in FIGS. 8 and 10, the wear projection 375 remains exposed outside of the lip 210, so as to absorb wear from the material dug up by the shovel 10.

With continued reference to FIG. 10, the modular shroud 220 includes an aperture 380 that extends from the first portion 360 of the modular shroud 220 to the second portion 365 of the modular shroud 220. As illustrated in FIG. 10, the aperture 380 is a through-aperture having a first region 385 with a first diameter 390 and a second region 395 with a second diameter 400. In some constructions, the first region 385 is threaded. The second diameter 400 is larger than the first diameter 390. The aperture 380 extends from an end surface 405 of the first portion 360 to an inclined surface 410 of the wear projection 375, along an axis 415. As illustrated in FIG. 10, the axis 415 is identical to an axis of insertion of the first portion 360 into the aperture 225 of the lip 210.

With continued reference to FIG. 10, as well as to FIG. 9, the same locking system 335 that releasably locks the modular adapter 215 to the lip 210 may alternatively be used to releasably lock the modular shroud 220 to the lip 210. Thus, as illustrated in FIG. 10, the fastener 340 may be inserted through the aperture 380 at the inclined surface 410, and may be coupled to the nut 355.

Figure 11:
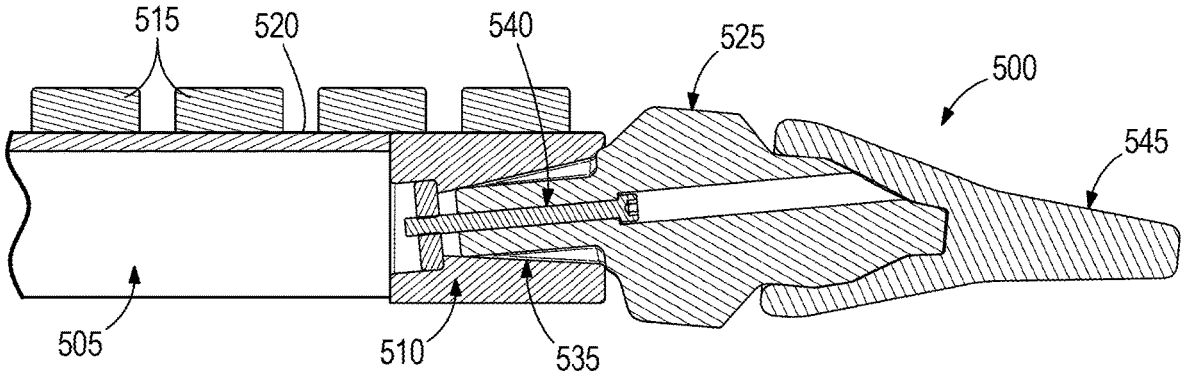
FIGS. 11-13 are perspective views of a modular ground engagement tooling system according to another construction, illustrating separate wear elements coupled to the lip.
Figure 12:
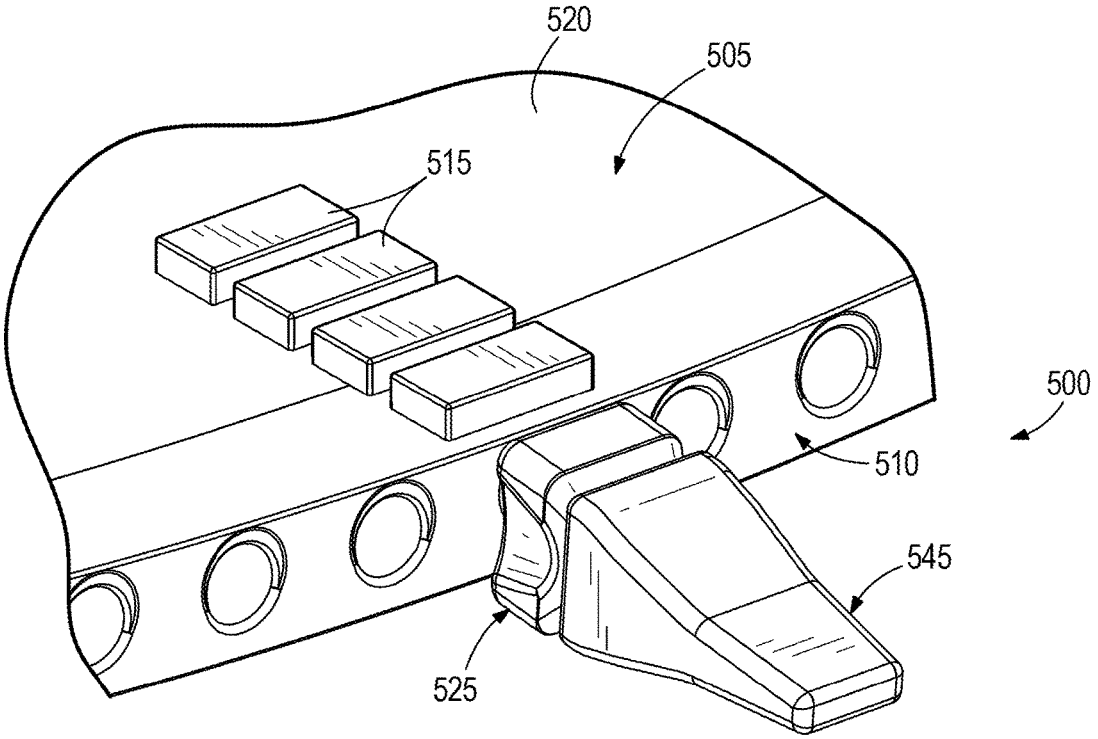
Figure 13:
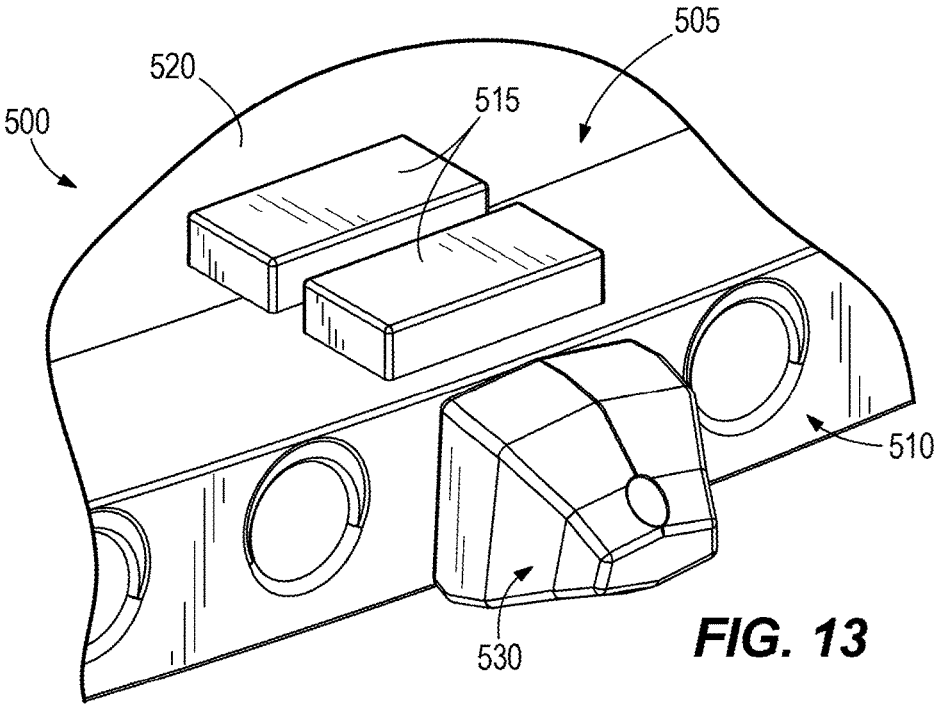

FIGS. 11-13 illustrate a modular ground engagement tooling system 500 that includes a dipper 505 having a lip 510, and separate wear components 515 coupled to the dipper 505 to further absorb wear from the material dug up by the shovel 10. The separate wear components 515 each have a generally rectangular shape, and project upwardly from an interior surface 520 of the dipper 505. Other constructions include different shapes and sizes than that illustrated. In some constructions, the separate wear components 515 are integrally formed as part of the dipper 505.

With continued reference to FIGS. 11-13, the modular ground engagement tooling system 500 includes modular adapters 525 (FIGS. 11 and 12) and modular shrouds 530 (FIG. 13) that each fit into any one of various apertures 535 in the lip 510, similar to the modular ground engagement tooling system 200. As illustrated in FIGS. 11-13, the separate wear components 515 are spaced and positioned generally adjacent the modular adapters 525 and shrouds 530, although other constructions include different locations. The modular ground engagement tooling system 500 also includes locking systems 540 to releasably lock the modular adapters 525 and modular shrouds 530 to the lip 510. Additionally, and similar to the modular adapters 215 described above, the modular adapters 525 couple to tooth points 545. Description of the modular adapters 525, modular shrouds 530, locking systems 540, and tooth points 545 are not provided, since they are identical to those described above in the modular ground engagement tooling system 200.

The use of separate wear components 515, in combination with the separate modular adapters 525 and modular shrouds 530 themselves, allows for the overall wear experienced by the dipper 505 to be divided amongst various components, and for each of the components to be replaced as needed based on its own experienced wear. For example, in some constructions the separate wear components 515 may wear slower than the modular adapters 525 or the modular shrouds 530 during use of the dipper 505. Thus, the modular adapters 525 and modular shrouds 530 may be replaced as needed, while the separate wear components 515 remain in place.

Figure 14:
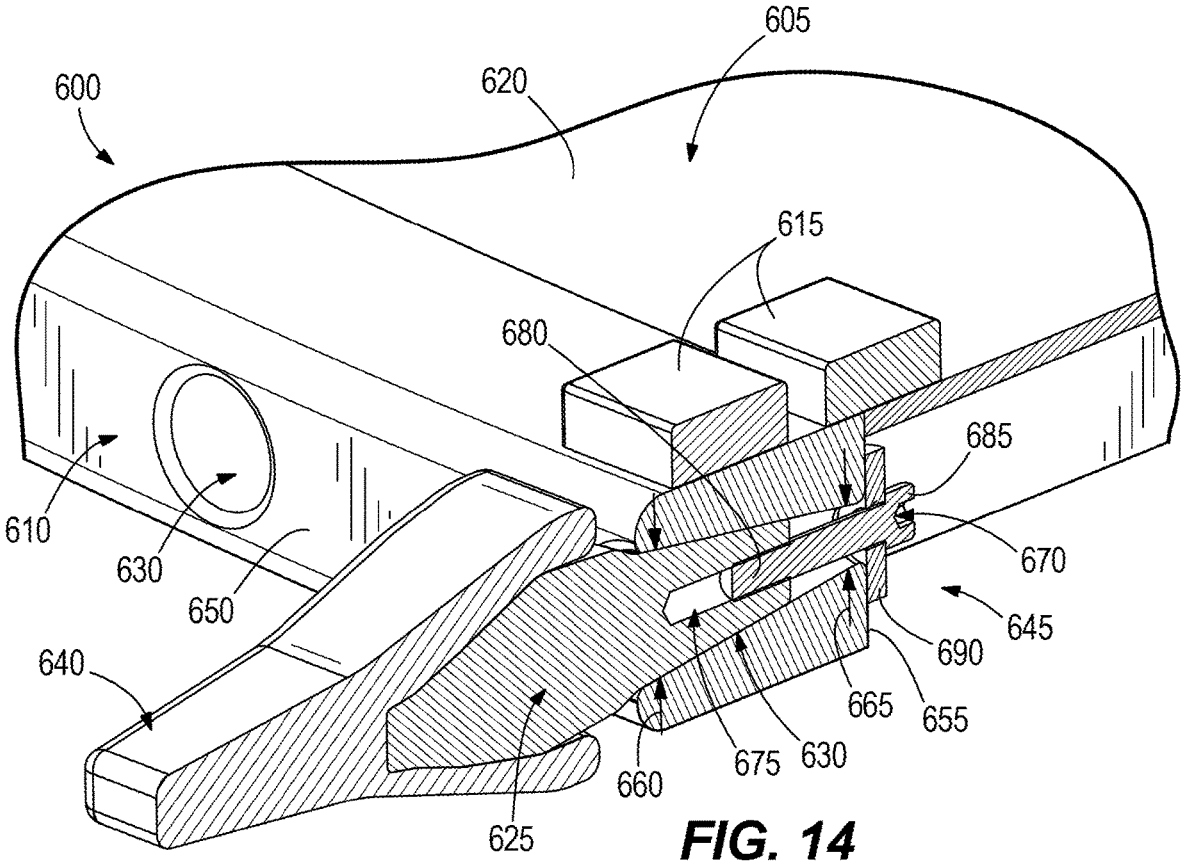
FIG. 14 is a perspective view of a modular ground engagement tooling system according to another construction, illustrating a locking system.

FIG. 14 illustrates a modular ground engagement tooling system 600 that includes a dipper 605 having a lip 610, and separate wear components 615 coupled to an interior surface 620 of the dipper 605 to further absorb wear from the material dug up by the shovel 10. The modular ground engagement tooling system 600 includes modular adapters 625 (and modular shrouds, not shown) that each fit into any one of various apertures 630 in the lip 610, similar to the modular ground engagement tooling systems 200 and 500. As illustrated in FIG. 14, the separate wear components 615 are spaced and positioned generally adjacent the modular adapters 625 and shrouds, although other constructions include different locations. The modular adapters 625 also couple to tooth points 640. Additionally, the modular ground engagement tooling system 600 also includes a locking system 645 to releasably lock the modular adapter 625 (or modular shroud) to the lip 610.

With continued reference to FIG. 14, the aperture 630 extends from a first, outer side 650 of the lip 610 to a second, opposite inner side 655 of the lip 610. The aperture 630 has a first diameter 660 adjacent the first, outer side 650 and a smaller, second diameter 665 adjacent the second, inner side 655. The aperture 630 tapers continuously between the first diameter 660 and the second diameter 665.

The locking system 645 includes a fastener 670 (e.g., a threaded bolt, similar or identical to the fastener 340 described above) that is shaped and sized to extend into an aperture 675 (e.g., threaded aperture) of the modular adapter 625. As illustrated in FIG. 14, the aperture 675 is a blind bore that opens at an interior end of the modular adapter 625 within the lip 610. The fastener 670 includes a first portion 680 (e.g., threaded) having a first diameter and a second portion 685 (e.g., a head) having a second, larger diameter. In some constructions, the second portion 685 is a head that receives a tool to push, thread, or otherwise move the fastener 670 into the aperture 675.

With continued reference to FIG. 14, the locking system 645 also includes a washer 690 having a diameter larger than the second diameter 665 of the aperture 630 of the lip 610. To lock the modular adapter 625, the fastener 670 is moved into (e.g., threaded into) the aperture 675 from behind the modular adapter 625 along a direction toward the tooth point 640. As the fastener 670 is turned, the second portion 685 eventually contacts the washer 690, which acts to prevent the second portion 685 from translating farther. As the fastener 670 is then rotated again, the modular adapter 625 is forced to pull tightly against the first, outer side 650 of the lip 610, thereby locking the modular adapter 625 to the lip 610.

FIGS. 15-18 illustrate a modular ground engagement tooling system 700 that includes a dipper 705 having a lip 710, separate wear components 725 (e.g. to absorb wear), and a plurality of separate modular adapters 715 and modular shrouds 720 that are releasably coupled to the lip 710 through apertures 730 in the lip 710. The modular adapters 715 are coupled to tooth points 740. In the illustrated construction, the apertures 730 extend entirely through the lip 710, although in other constructions the apertures 730 extend only partially through the lip 710 (e.g., as blind bores). The modular ground engagement tooling system 700 also includes a locking system 745 to releasably lock the modular adapters 715 and/or modular shrouds 720 to the lip 710. The modular ground engagement tooling system 700 is similar to the modular ground engagement tooling systems 200, 500, and 600, and only differences will be discussed herein for the sake of brevity.

Figure 16:
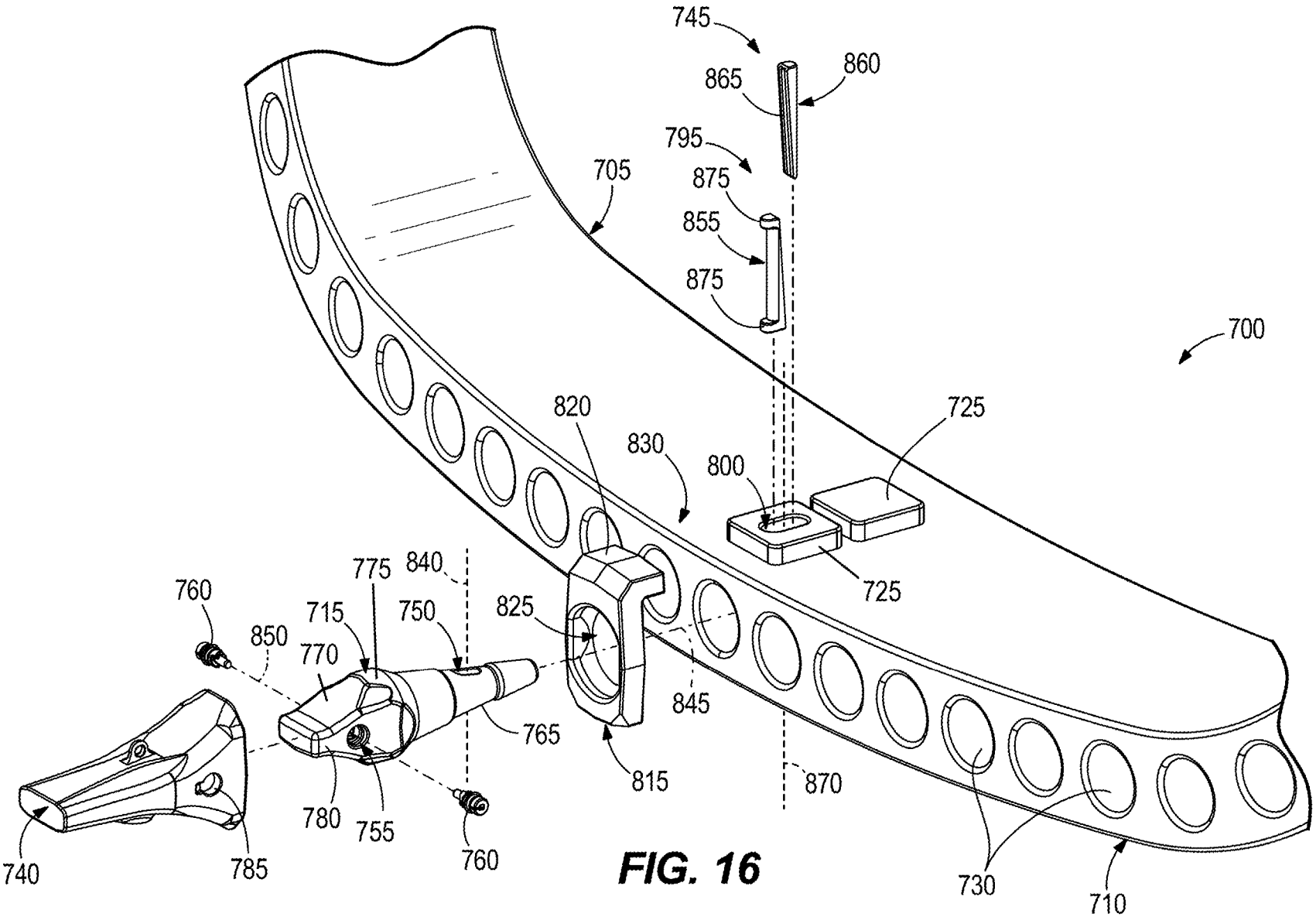
FIG. 16 is an exploded view of the modular ground engagement tooling system of FIG. 15, illustrating a locking system.
Figure 17:
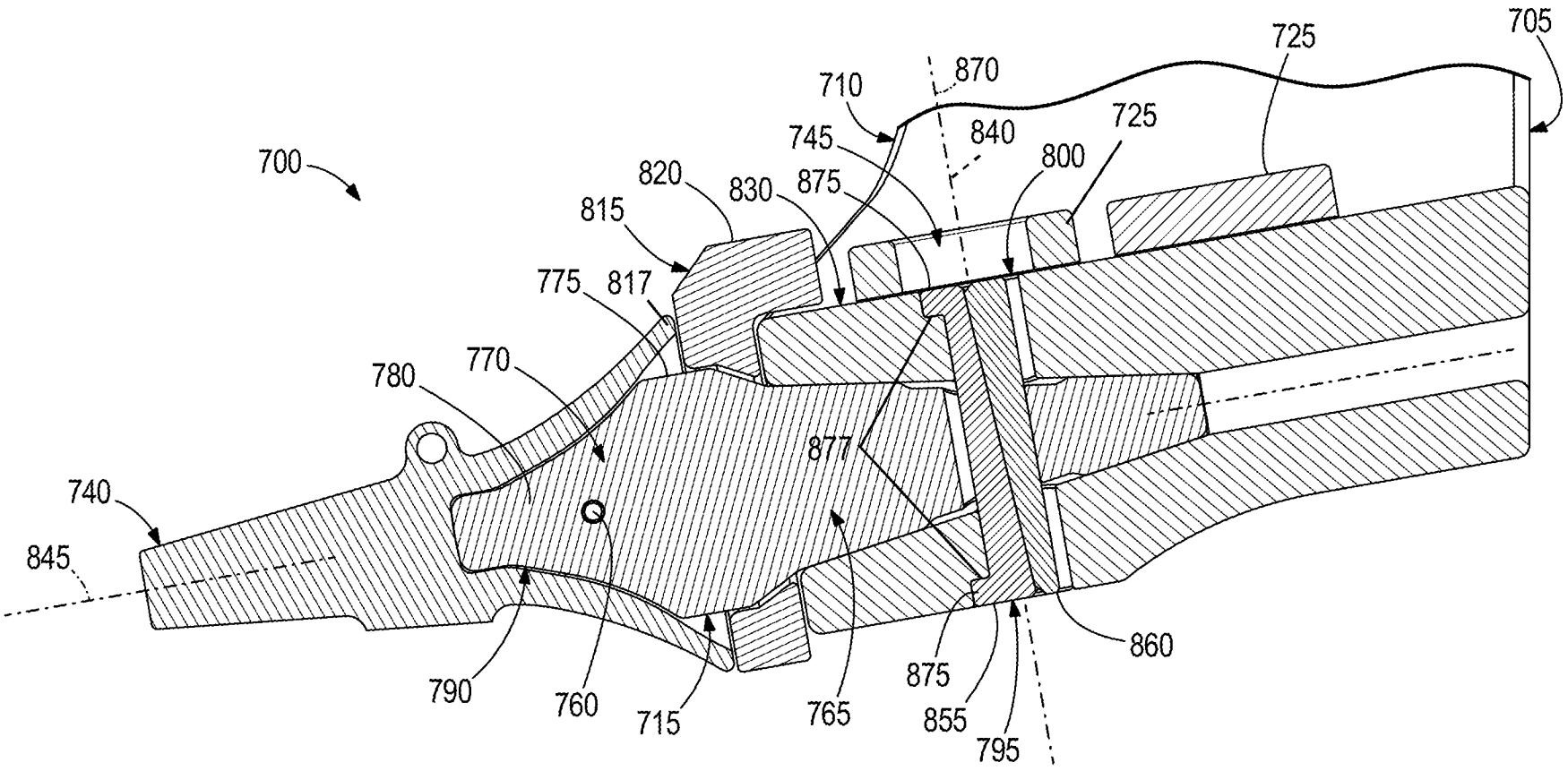
FIGS. 17 and 18 are cross-sectional and perspective views of modular adapters of the modular ground engagement tooling system of FIG. 15.
Figure 18:
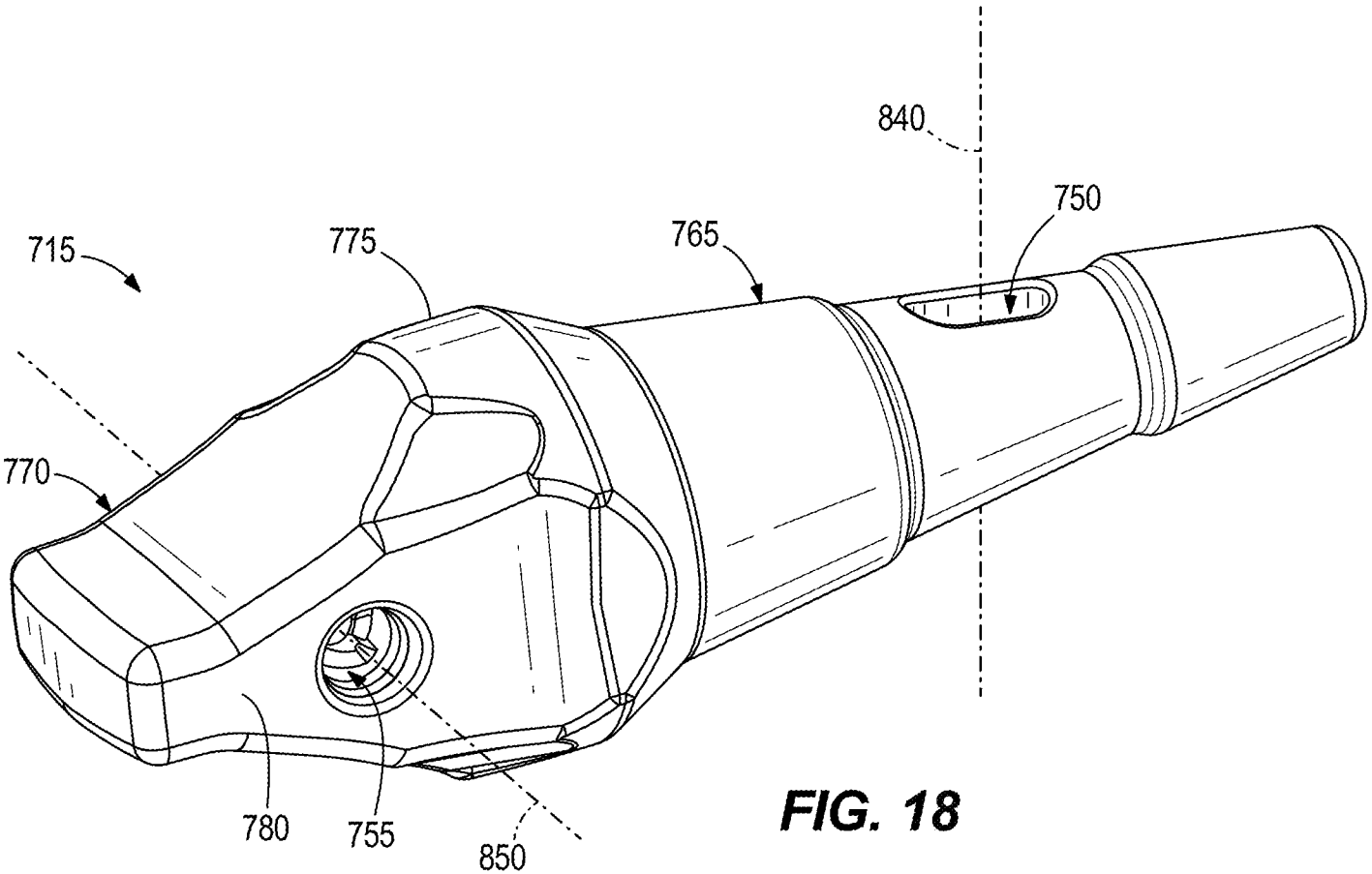

With reference to FIGS. 16-18, each of the modular adapters 715 includes a first portion 765 sized and shaped to fit into any one of the apertures 730, and a second portion 770 extending from the first portion 765 that is sized and shaped to extend out of the aperture 730. In the illustrated construction, the first and second portions 765, 770 are each tapered, although other constructions include different shapes and sizes than that illustrated. The first portion 765 includes a slot 750 oriented along an axis 840 that is perpendicular to an axis 845 along which the modular adapter 715 is inserted through the aperture 730. The slot 750 extends entirely through the first portion 765 along the axis 840. The second portion 770 includes a central body 775 and a mating projection 780 that extends from the central body 775 and that is sized and shaped to couple to the tooth point 740. Connecting apertures 755 extend into the mating projection 780 and are oriented along an axis 850 that is orthogonal to both the axis 840 and the axis 845. In some constructions, the connecting apertures 755 together form a single through-aperture that extends entirely through the mating projection 780.

As illustrated in FIGS. 17 and 18, the mating projection 780 is sized and shaped to fit into a correspondingly-shaped female recess 790 of the tooth point 740. The tooth point 740 is held onto the mating projection 780 and the modular adapter 715 via pins 760 (FIG. 16) that are inserted into the connecting apertures 755. The tooth point 740 has apertures 785 (FIG. 16) that align with the connecting apertures 755 (FIG. 16) when the mating projection 780 is fit into the female recess 790. In the illustrated construction, each pin 760 is inserted through one aperture 785 and one connecting aperture 755 to couple the tooth point 740 to the modular adapter 715. Other constructions various other mechanisms (other pins, etc.) by which to couple the modular adapter 715 to the tooth point 740.

With continued reference to FIGS. 16 and 17, the locking system 745 includes a fastener 795. In the illustrated construction the fastener 795 includes a first wedge element 855 with tabs 875 and a second wedge element 860. The locking system 745 further includes an aperture 800 that extends into the dipper lip 710 (and in some embodiments further extends through one of the separate wear components 725 on the lip 710). The aperture 800 intersects the aperture 730 along an axis 870 that is parallel to, or coincident with, the axis 840.

During assembly, the modular adapter 715 is inserted into the aperture 730 so that the slot 750 is aligned with the aperture 800 along the axis 870. The fastener 795 is then inserted through the aperture 800 and the slot 750 to couple the modular adapter 715 to the dipper lip 710. For example, in some constructions the first wedge element 855 is inserted through the aperture 800 and the slot 750. The second wedge element 860 is then inserted (e.g., driven via a hammer or other tool) through the aperture 800 and the slot 750. Rails 865 positioned on the second wedge element 860 couple to rails (not shown) on the first wedge 855, thereby guiding and coupling the first and second wedge elements 855, 860 together. When the first and second wedge elements 855, 860 are coupled together and the second wedge element 860 has been driven down, the tabs 875 extend over and onto ledges 877 inside the lip 710, thereby helping to secure the modular adapter 715 in place. Other constructions include different fasteners 795 than that illustrated that may be inserted partially or entirely through the aperture 800 to secure the modular adapter 715 to the dipper lip 710.

Figure 15:
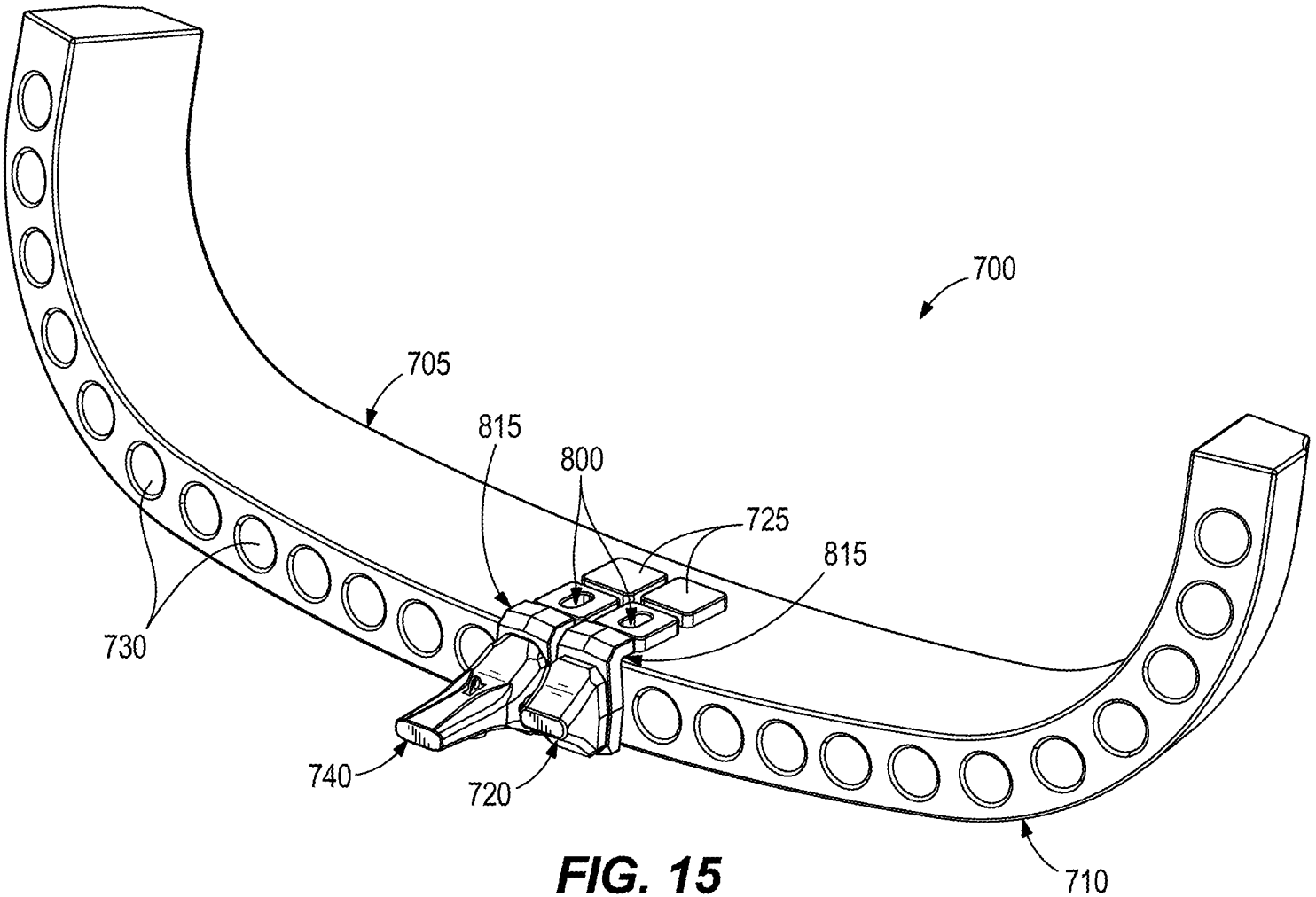
FIG. 15 is a perspective view of a modular ground engagement tooling system according to another construction.

With reference to FIGS. 15-17, in some constructions a collar 815 extends around a portion of the central body 775 (or around a portion of a shroud 720). As illustrated in FIG. 16, the collar 815 includes a projection 820 and a central opening 825. The projection 820 is fit over an inner surface 830 of the dipper 705 (the inner surface 830 facing an inside of the dipper 705 that receives material) so that the collar 815 may abut with the lip 710. The first portion 765 of the modular adapter 715 is inserted through the central opening 825 of the collar 815 when the modular adapter 715 is inserted into the aperture 730. In some constructions, the cross-section of the central opening 825 is generally similar in size and shape to the cross-section of the central body 775. This provides the modular adapter 715 with a secure fit within the collar 815. In the illustrated construction, and as illustrated in FIG. 17, an end 817 of the tooth point 740 is adjacent to the collar 815 when the modular adapter 715 is coupled to the dipper 705, such that the collar 815 is tightly fitted between the tooth point 740 and the dipper lip 710. Other constructions include various other shapes and sizes of collars 815 than that illustrated.

In some constructions, one or more of the modular adapters 215, 525, 625, 715 described herein are formed integrally as a single piece with their corresponding tooth points 285, 545, 640, 740, thereby forming single-piece wear structures (e.g., monolithic structures) that are inserted into one of the apertures in the dipper lip. For example, and with reference to FIG. 17, in some constructions the mating projection 780 does not mate with a tooth point 740. Rather, the mating projection 780 and the tooth point 740 are integrally formed as one structure, extending away from the central body 775.

Although the invention has been described in detail with reference to certain preferred embodiments, variations and modifications exist within the scope and spirit of one or more independent aspects of the invention as described.

What is claimed is:

1. A tooling system comprising:

a modular adapter configured to be inserted partially into any one of a plurality of apertures in a lip of a dipper along an axis of insertion, wherein the adapter is configured to be releasably coupled to the lip, the adapter including a first conical portion configured to extend into the aperture, and a second portion configured to extend out of the aperture;

a locking system including a fastener configured to extend at least partially into the aperture and couple the adapter to the lip; and a separate wear component configured to be coupled to an inner surface of the dipper;

wherein the aperture is a first aperture, wherein the adapter includes a second aperture extending at least partially through the adapter along an axis that is perpendicular to the axis of insertion, wherein the second aperture is configured to be aligned with a third aperture in the lip, the third aperture configured to intersect the first aperture and be aligned with the second aperture when the adapter is coupled to the lip, and wherein the third aperture is configured to extend through the separate wear component.

2. The tooling system of claim 1, further comprising a tooth point configured to be releasably coupled to the second portion of the adapter.

3. The tooling system of claim 1, further comprising the dipper and the lip.

4. The tooling system of claim 1, wherein the fastener is configured to extend into the second and third apertures to couple the adapter to the lip.

5. The tooling system of claim 1, wherein the fastener includes a first wedge element and a second wedge element, wherein the second wedge element includes rails configured to guide movement of the second wedge element relative to the first wedge element, wherein the second wedge element is configured to be driven into engagement with the first wedge element.

6. The tooling system of claim 1, further comprising a modular shroud configured to be inserted partially into any one of the apertures of the lip.

7. The tooling system of claim 1, further comprising a collar configured to be coupled to the lip, wherein the collar includes a central opening, wherein the first portion of the adapter is configured to extend through the central opening.

8. A tooling system comprising:

a modular adapter configured to be inserted partially into any one of a plurality of apertures in a lip of a dipper along an axis of insertion, wherein the adapter is configured to be releasably coupled to the lip, the adapter including a first portion configured to extend into the aperture, and a second portion configured to extend out of the aperture;

a locking system including a fastener configured to extend at least partially into the aperture and couple the adapter to the lip; and a collar configured to be coupled to the lip, wherein the collar is a separate component from the modular adapter, and includes a central opening, wherein the first portion of the adapter is configured to extend through the central opening.

9. The tooling system of claim 8, wherein the collar includes a projection configured to fit over an inner surface of the lip of the dipper.

10. The tooling system of claim 8, further comprising the dipper and the lip.

11. The tooling system of claim 8, wherein the aperture is a first aperture, wherein the adapter includes a second aperture extending through the first portion, wherein the second aperture is configured to receive the fastener to couple the adapter to the lip.

12. The tooling system of claim 8, wherein the first portion is tapered.

13. The tooling system of claim 8, further comprising the dipper and the lip, wherein the collar is in abutment with the lip.

14. The tooling system of claim 13, wherein each of the plurality of apertures in the lip extends entirely through the lip.

15. A tooling system comprising:

a modular adapter extending along a first axis and configured to be inserted partially along the first axis into any one of a plurality of apertures in a lip of a dipper, wherein the adapter is configured to be releasably coupled to the lip, the adapter including a first conical portion configured to extend into the aperture in the lip, and a tapered second portion configured to extend out of the aperture, wherein the second portion includes a central body and a mating projection extending from the central body, wherein a connecting aperture extends along a second axis into the mating projection, wherein the second axis is perpendicular to the first axis, wherein the first portion includes a slot that extends entirely through the first portion along a third axis that is perpendicular to both the first axis and the second axis, wherein the tooling system further comprises a collar configured to be coupled to the lip of the dipper, wherein the collar includes a central opening, wherein central opening is sized and shaped to receive the first portion of the adapter.

16. The tooling system of claim 15, further comprising a locking system including a fastener configured to extend into the slot and couple the adapter to the lip.

17. The tooling system of claim 16, wherein the fastener includes a first wedge element and a second wedge element, wherein the second wedge element includes rails configured to guide movement of the second wedge element relative to the first wedge element, wherein the second wedge element is configured to be driven into engagement with the first wedge element.

18. The tooling system of claim 15, further comprising the dipper and the dipper lip.

19. A tooling system comprising:

a modular shroud configured to be inserted partially into any one of a plurality of apertures in a lip of a dipper along an axis of insertion, wherein the shroud is configured to be releasably coupled to the lip, the shroud including a first conical portion configured to extend into the aperture, and a second portion configured to extend out of the aperture;

a locking system including a fastener configured to extend at least partially into the aperture and couple the shroud to the lip; and a separate wear component configured to be coupled to an inner surface of the dipper;

wherein the aperture is a first aperture, wherein the shroud includes a second aperture extending at least partially through the shroud along an axis that is perpendicular to the axis of insertion, wherein the second aperture is configured to be aligned with a third aperture in the lip, the third aperture configured to intersect the first aperture and be aligned with the second aperture when the shroud is coupled to the lip, and wherein the third aperture is configured to extend through the separate wear component.

20. A tooling system comprising:

a modular shroud configured to be inserted partially into any one of a plurality of apertures in a lip of a dipper along an axis of insertion, wherein the shroud is configured to be releasably coupled to the lip, the shroud including a first portion configured to extend into the aperture, and a second portion configured to extend out of the aperture;

a locking system including a fastener configured to extend at least partially into the aperture and couple the shroud to the lip; and a collar configured to be coupled to the lip, wherein the collar includes a central opening, wherein the first portion of the shroud is configured to extend through the central opening.

* * * * *